US009593826B2

(12) United States Patent
Greenwood et al.

(10) Patent No.: US 9,593,826 B2
(45) Date of Patent: Mar. 14, 2017

(54) STROBE ASSEMBLY

(71) Applicant: UTC FIRE & SECURITY AMERICAS CORPORATION, INC., Lincolnton, NC (US)

(72) Inventors: Thomas Greenwood, Terra Ceia, FL (US); Martin Paul Robotham, Bradenton, FL (US)

(73) Assignee: UTC FIRE & SECURITY AMERICAS CORPORATION, INC., Lincolnton, NC (US)

( * ) Notice: Subject to any disclaimer, the term of this patent is extended or adjusted under 35 U.S.C. 154(b) by 218 days.

(21) Appl. No.: 14/510,343

(22) Filed: Oct. 9, 2014

(65) Prior Publication Data

US 2015/0167928 A1 Jun. 18, 2015

Related U.S. Application Data

(60) Provisional application No. 61/915,199, filed on Dec. 12, 2013.

(51) Int. Cl.

| | |
|---|---|
| ***F21V 7/09*** | (2006.01) |
| ***F21V 7/06*** | (2006.01) |
| ***F21V 33/00*** | (2006.01) |
| ***G08B 5/38*** | (2006.01) |
| *F21W 111/00* | (2006.01) |

(52) U.S. Cl.

CPC ..... *F21V 7/09* (2013.01); *F21V 7/06* (2013.01); *F21V 33/0076* (2013.01); *G08B 5/38* (2013.01); *F21W 2111/00* (2013.01)

(58) Field of Classification Search

CPC ..... F21V 7/06; F21V 7/09; F21V 33/0076; F21S 48/1358–48/1382

See application file for complete search history.

(56) References Cited

U.S. PATENT DOCUMENTS

| | | | | |
|---|---|---|---|---|
| 1,639,363 | A * | 8/1927 | Balsillie | F21S 48/1376 362/348 |
| 5,690,422 | A | 11/1997 | Brass | |
| 5,710,854 | A | 1/1998 | Myers et al. | |
| 6,024,475 | A | 2/2000 | Kufrovich et al. | |
| 6,243,001 | B1 | 6/2001 | Kodaka | |
| 6,529,652 | B1 | 3/2003 | Brener | |
| 6,601,970 | B2 | 8/2003 | Ueda et al. | |
| 6,793,375 | B2 | 9/2004 | Anderson | |

(Continued)

FOREIGN PATENT DOCUMENTS

| | | | |
|---|---|---|---|
| EP | 1650722 | A2 | 4/2006 |
| WO | 8905964 | A1 | 6/1989 |

*Primary Examiner* — Julie Bannan

(74) *Attorney, Agent, or Firm* — Cantor Colburn LLP

(57) ABSTRACT

A modular reflector assembly includes two portions arranged symmetrically at a common plane. Each portion includes a first surface defined by a first parabola rotated to a first angle relative to the plane and a second surface abutting the first surface defined by a second parabola rotated to a second angle greater than the first angle. A third surface abuts the second surface and is defined by a third parabola rotated to a third greater than the second angle. A fourth surface abuts the third surface and is defined by a fourth parabola rotated to a fourth angle greater than the third angle. A fifth surface abuts the first surface and is defined by a fifth parabola rotated in the common plane to a fifth angle relative to the first axis.

10 Claims, 10 Drawing Sheets

(56) References Cited

U.S. PATENT DOCUMENTS

| | | | | |
|---|---|---|---|---|
| 7,059,731 | B2 | 6/2006 | Lee et al. | |
| 7,261,440 | B2 * | 8/2007 | Kwasny | G02B 5/10 362/297 |
| 7,445,363 | B2 * | 11/2008 | Vanden Eynden | F21V 7/10 362/292 |
| 7,455,431 | B2 | 11/2008 | Brower et al. | |
| 7,850,345 | B2 | 12/2010 | Holder et al. | |
| 8,845,136 | B2 * | 9/2014 | Savage, Jr. | F21V 7/0025 362/278 |
| 2003/0086269 | A1 * | 5/2003 | Anderson | F21V 7/005 362/304 |
| 2005/0128748 | A1 | 6/2005 | Suwa | |
| 2013/0039090 | A1 | 2/2013 | Dau et al. | |
| 2013/0208495 | A1 | 8/2013 | Dau et al. | |

* cited by examiner

STROBE ASSEMBLY

CROSS-REFERENCE TO RELATED APPLICATIONS

This application claims the benefit of U.S. provisional patent application Ser. No. 61/915,199, filed Dec. 12, 2013, the entire contents of which are incorporated herein by reference.

BACKGROUND OF THE INVENTION

The subject invention relates to strobe and reflector units. More particularly, the subject invention relates to strobe and reflector units utilized to provide visual warnings of alarm conditions.

Many varieties of strobe and reflector combinations are utilized as visual warning devices in warning systems, for example, fire detection systems. When the fire detection system is triggered by, for example, smoke or flame conditions detected by the fire detection system, the strobe and reflector combination is activated, often in conjunction with an audible alarm. Different fire detection systems and/or jurisdictions require the light emitted by the strobe and reflector combination to produce a particular output pattern, meeting standards, such as those set by Underwriters Laboratories ("UL"). The goal when configuring the strobe and reflector combination is to produce the required output pattern with the required illumination, while minimizing the power requirements to do so.

BRIEF DESCRIPTION

In one embodiment, a modular reflector assembly includes two portions arranged symmetrically at a common plane. Each portion includes a first surface intersecting the common plane defined by a first parabolic curve revolved about a first axis of revolution rotated to a first angle relative to the common plane and a second surface abutting the first surface defined by a second parabolic curve revolved about a second axis of revolution rotated to a second angle relative to the common plane, the second angle having a value greater than the first angle. A third surface abuts the second surface and is defined by a third parabolic curve revolved about a third axis of revolution rotated to a third angle relative to the common plane, the third angle having a value greater than the second angle. A fourth surface abuts the third surface and is defined by a fourth parabolic curve revolved about a fourth axis of revolution rotated to a fourth angle relative to the common plane, the fourth angle having a value greater than the third angle. A fifth surface abuts the first surface and is defined by a fifth parabolic curve revolved about a fifth axis of revolution rotated in the common plane to a fifth angle relative to the first axis of revolution. A sixth surface abuts the fifth surface and is defined by a sixth parabolic curve revolved about a sixth axis of revolution rotated in the common plane to a sixth angle relative to the first axis of revolution, the sixth angle having a greater value than the fifth angle.

In another embodiment, a strobe assembly includes a light source disposed along a source axis and a modular reflector assembly including two portions arranged symmetrically at a common plane including the source axis, each portion including a first surface intersecting the common plane defined by a first parabolic curve revolved about a first axis of revolution rotated to a first angle relative to the common plane and a second surface abutting the first surface defined by a second parabolic curve revolved about a second axis of revolution rotated to a second angle relative to the common plane, the second angle having a value greater than the first angle. A third surface abuts the second surface and is defined by a third parabolic curve revolved about a third axis of revolution rotated to a third angle relative to the common plane, the third angle having a value greater than the second angle. A fourth surface abuts the third surface and is defined by a fourth parabolic curve revolved about a fourth axis of revolution rotated to a fourth angle relative to the common plane, the fourth angle having a value greater than the third angle. A fifth surface abuts the first surface and is defined by a fifth parabolic curve revolved about a fifth axis of revolution rotated in the common plane to a fifth angle relative to the first axis of revolution. A sixth surface abuts the fifth surface and is defined by a sixth parabolic curve revolved about a sixth axis of revolution rotated in the common plane to a sixth angle relative to the first axis of revolution, the sixth angle having a greater value than the fifth angle.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawing in which:

DETAILED DESCRIPTION

Figure 1:
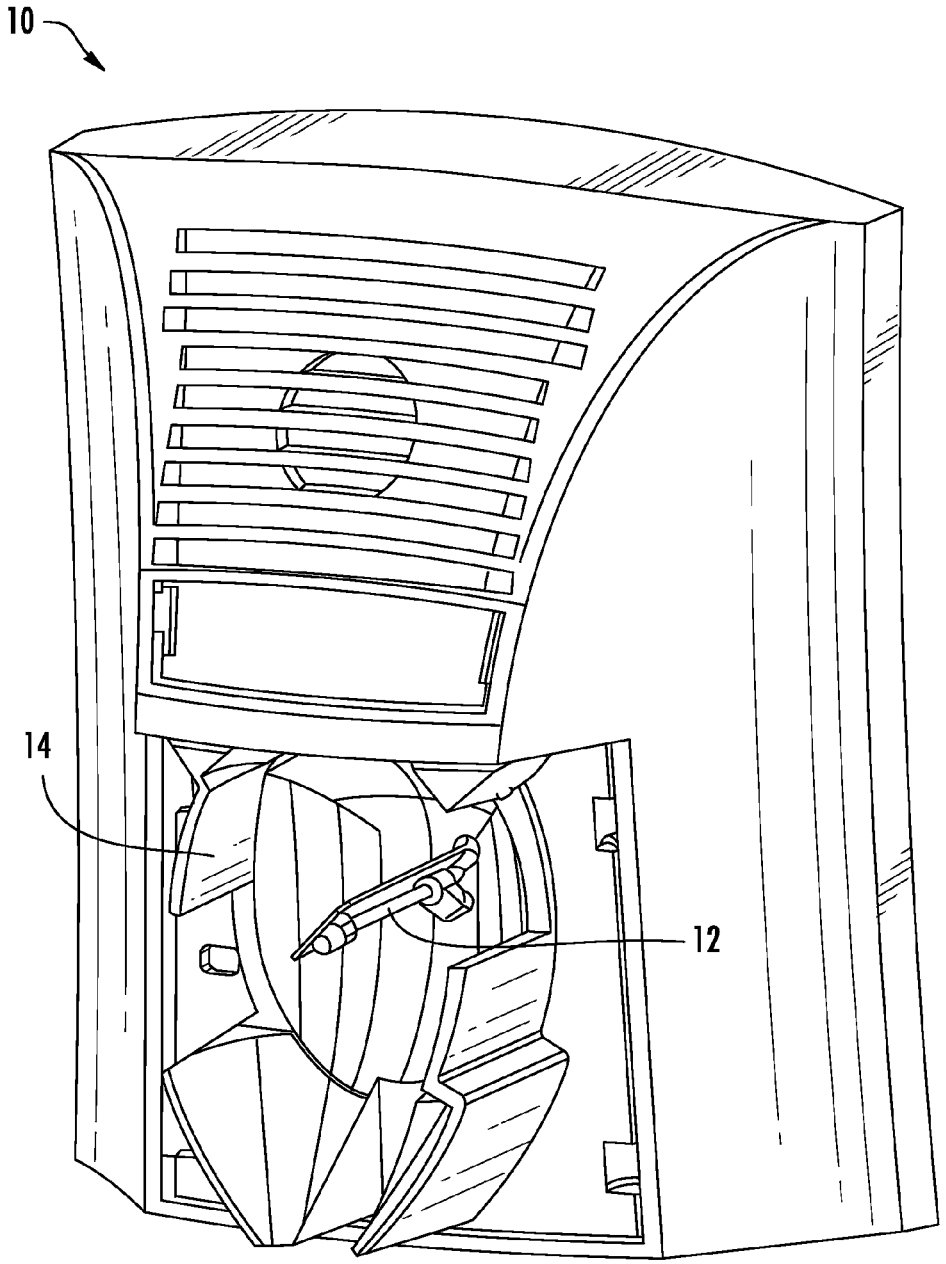
FIG. 1 is a perspective view of an embodiment of a strobe assembly.

Shown in FIG. 1 is a strobe assembly 10, including a source 12 and a reflector 14. The reflector 14 is formed of a multiple of reflector surfaces having a mirror finish via plating, polishing or the like, shown in FIG. 2. As will be described in greater detail below, the reflector surfaces are arranged to produce a T-shaped output pattern 16, shown for example in FIG. 3, such as that required by standards such as UL 1971. The reflector arrangement optimizes light energy in forming the required pattern while minimizing light energy projected to areas where it is not required, thus reducing the amount of energy required to operate the assembly 10, allowing for more assemblies 10 to be utilized on a system loop, thus reducing the cost of the overall fire detection system.

Figure 4:
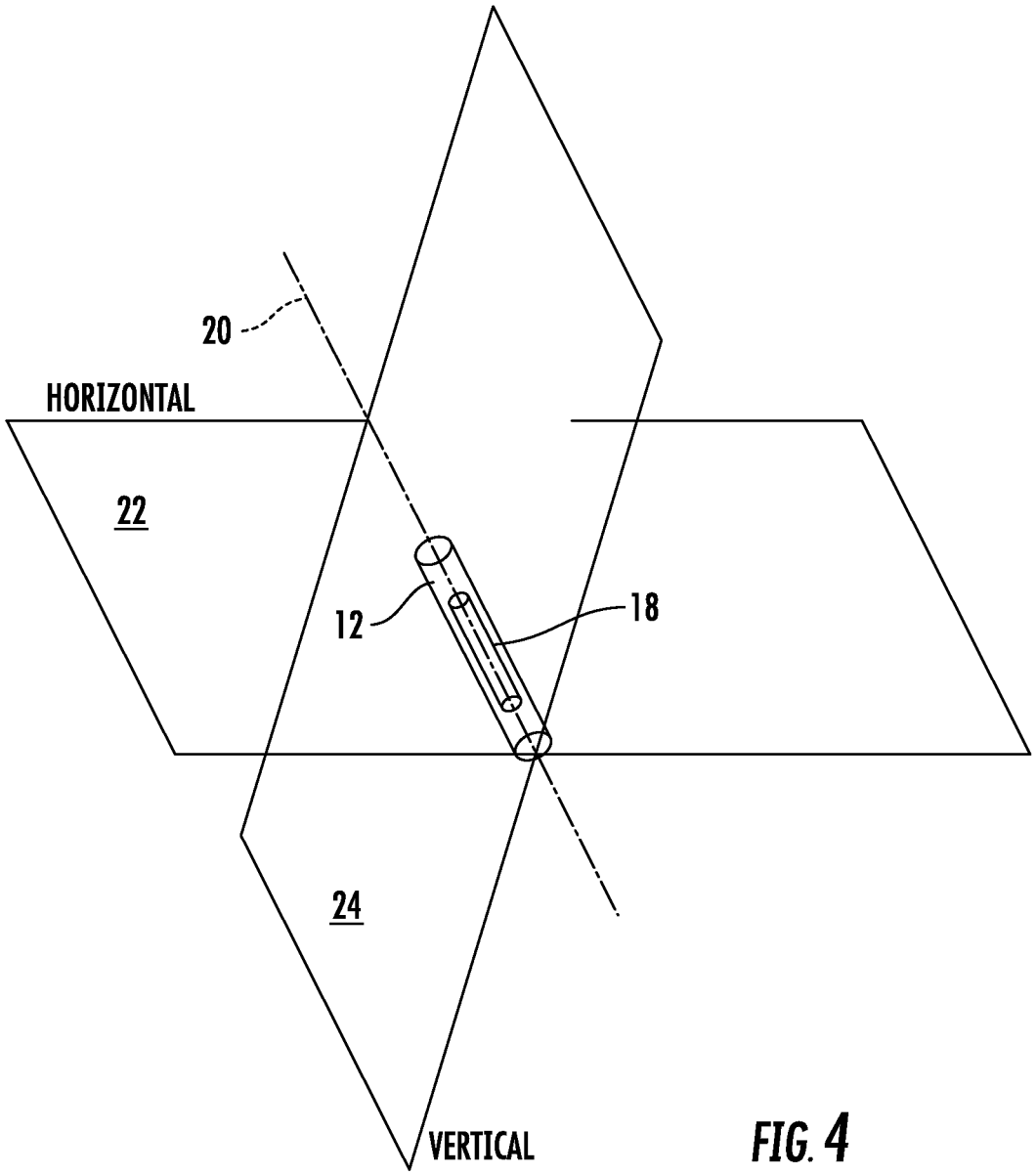
FIG. 4 schematically illustrates horizontal and vertical illumination planes and a source axis of an embodiment of a strobe assembly.

Referring again to FIG. 2, the reflector 14 includes a plurality of reflector sets: A, B, C, D, E, F, G, and H having a common focal point 18 to direct illumination to form the output pattern 16. The surfaces A-H have varying focal lengths in aiming directions as described in more detail below. They are focused around the common focal point 18, which is located at a center of the source 12, best shown in FIG. 4. As those skilled in the art will appreciate, the optical emissions from the reflector 14 are in part measured relative to predetermined horizontal and vertical planes, such as planes 22 and 24. The planes 22 and 24 are orthogonal to one another and intersect at the source axis 20. In a wall mountable configuration, the source axis 20 extends generally perpendicular to the wall. The surface pairs A-G are stacked partial parabolic surfaces, which are arranged symmetrically relative to the vertical plane 24.

Figure 2:
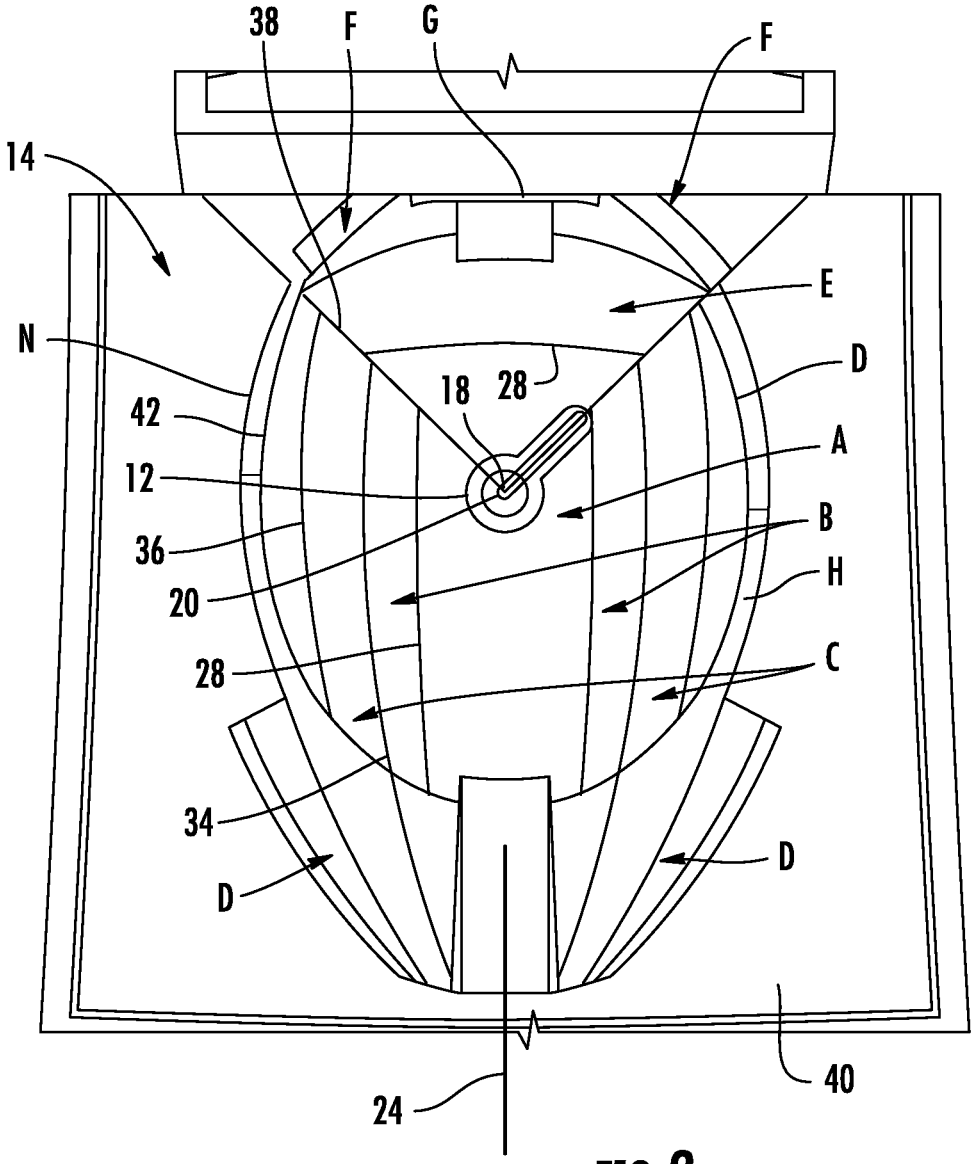
FIG. 2 is a schematic plan view of an embodiment of a strobe assembly.
Figure 5:
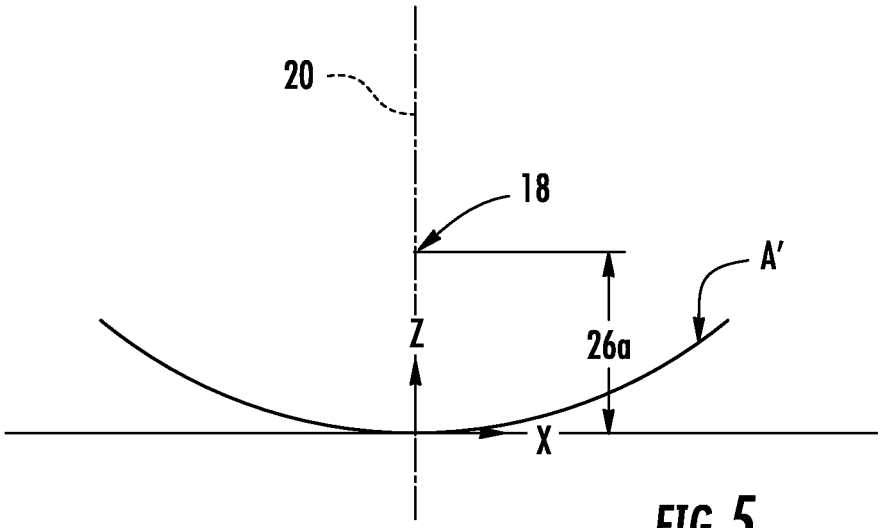
FIG. 5 is a schematic illustration of surface A of an embodiment of a strobe assembly.

As illustrated in FIG. 5, surface A is formed of a portion of parabola A' having a focal length 26*a*, which in an exemplary embodiment is about 0.49 inches. The parabola A' is revolved around the source axis 20 to form the surface A. One skilled in the art will appreciate that surfaces B and surfaces E truncate surface A along their intersecting curves 28, as shown in FIG. 2.

Figure 6:
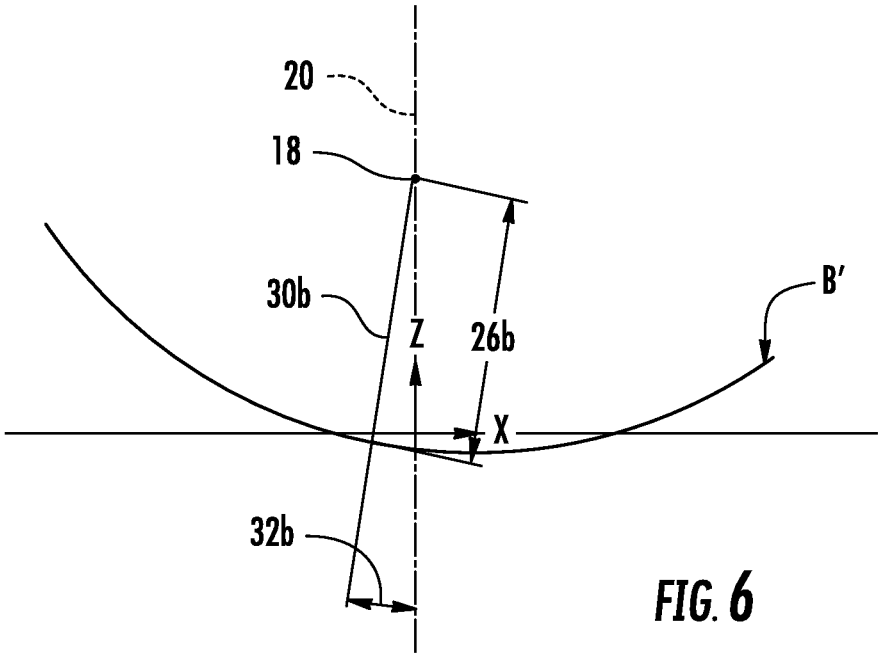
FIG. 6 is a schematic illustration of surface B of an embodiment of a strobe assembly.

As shown in FIG. 6, parabola B' is used to form each of the surfaces B on each side of vertical plane 24. Parabola B' is defined in the horizontal plane 22 and has a focal length of 26*b*, which in an exemplary embodiment is about 0.509 inches. An axis of revolution 30*b* of parabola B' is rotated through a tilt angle 32*b*, which in an exemplary embodiment is about 10 degrees relative to the source axis 20. Parabola B' is then revolved around axis 30*b* to form surface B, best shown in FIG. 2. As with surface A, surface B is truncated at its intersection with surface A at curves 28, and at its intersections with surfaces C at curves 34, as shown in FIG. 2.

Figure 7:
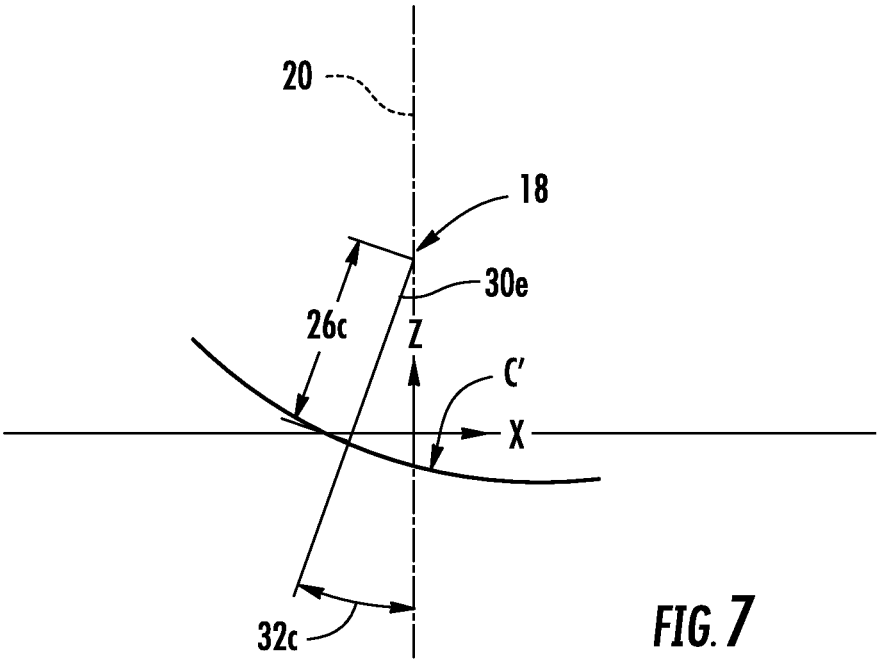
FIG. 7 is a schematic illustration of surface C of an embodiment of a strobe assembly.

Referring now to FIG. 7, parabola C' is used to form each of the surfaces C on each side of vertical plane 24. Parabola C' is defined in the horizontal plane 22 and has a focal length of 26*c*, which in an exemplary embodiment is about 0.542 inches. An axis of revolution 30*c* of parabola C' is rotated through a tilt angle 32*c* of about 20 degrees relative to the source axis 20. Parabola C' is then revolved around the axis 30*c* to form the surface C. Each surface C is truncated at its intersection with surface B at curves 34 and at its intersection with surface D at curves 36 and surface E at curves 38, as shown in FIG. 2.

Figure 8:
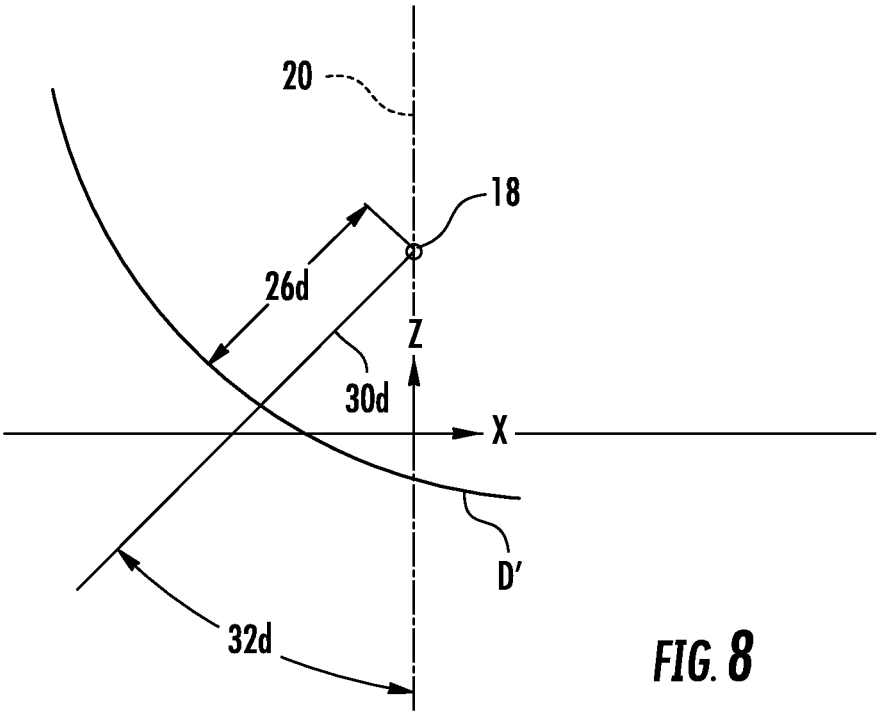
FIG. 8 is a schematic illustration of surface D of an embodiment of a strobe assembly.

Referring now to FIG. 8, parabola D' is used to form each of the surfaces D on each side of the vertical plane 24. Parabola D' is defined in the horizontal plane 22 and has a focal length of 26*d*, which in an exemplary embodiment is about 0.590 inches. An axis of revolution 30*d* of parabola D' is rotated through a tilt angle 32*d* of about 45 degrees relative to the source axis 20. Parabola D' is then revolved around the axis 30*d* to form the surface D. Each surface D is truncated at its intersection with surface C at curves 36 and surface E at curves 38. Further, each surface D is truncated by intersection with a base surface 40 orthogonal to source axis 20, defining curves 42, as shown in FIG. 2.

Figure 9:
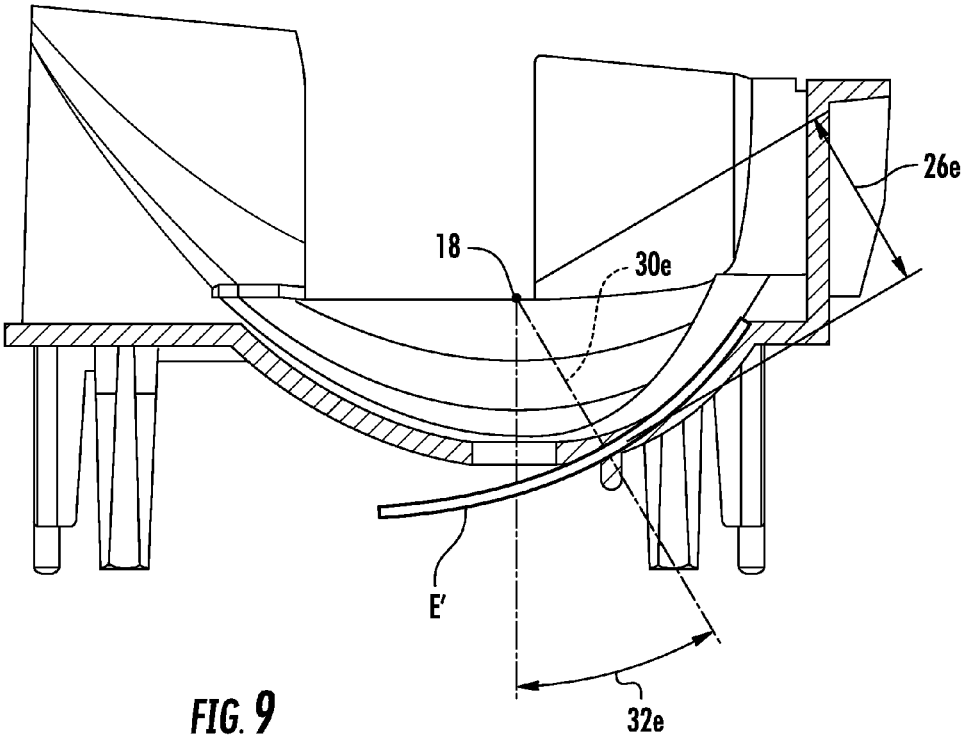
FIG. 9 is a schematic illustration of surface E of an embodiment of a strobe assembly.

Surface E straddles the vertical plane 24 and extends between surface A and the base surface 40. Referring now to FIG. 9, parabola E' is used to form surface E. Parabola E' is defined in the vertical plane 24 and has a focal length 26*e*, which in an exemplary embodiment is about 0.58 inches. An axis of revolution 30*e* of parabola E' is rotated through a tilt angle 32*e* of about 30 degrees relative to the source axis 20. Parabola E' is then revolved around the axis 30*e* to form the surface E.

Figure 10:
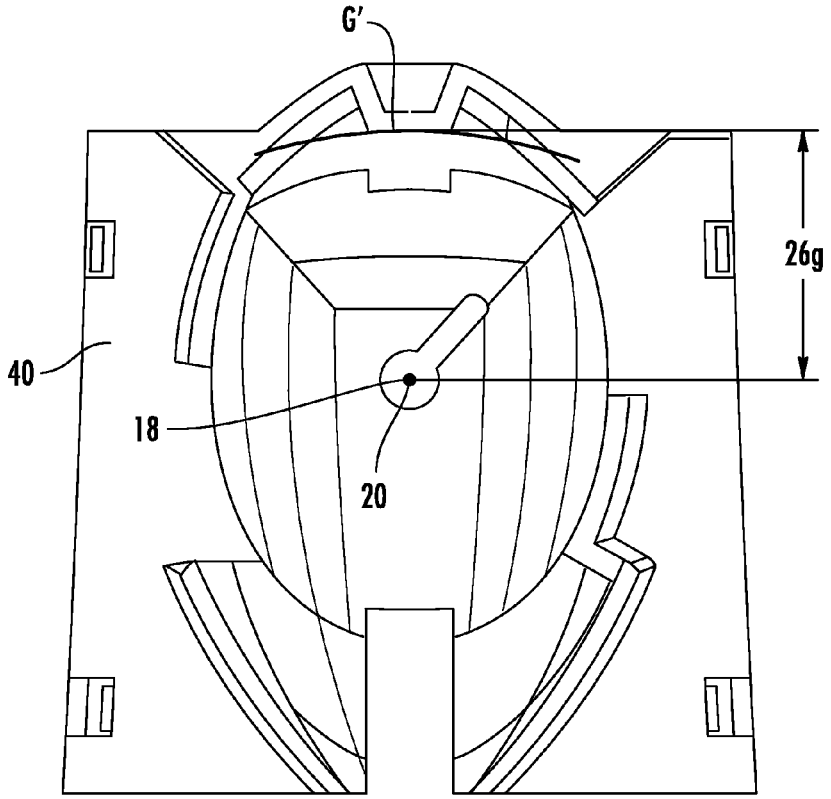
FIG. 10 is a schematic illustration of surface G of an embodiment of a strobe assembly.

Referring to FIG. 10, surface G is formed using parabola G' having a focal length 26*g*, in an exemplary embodiment, of about 0.940 inches in a plane parallel to the base surface 40. The parabola G' is extruded or translated along the source axis 20 from the base surface 40 to form surface G.

Figure 11:
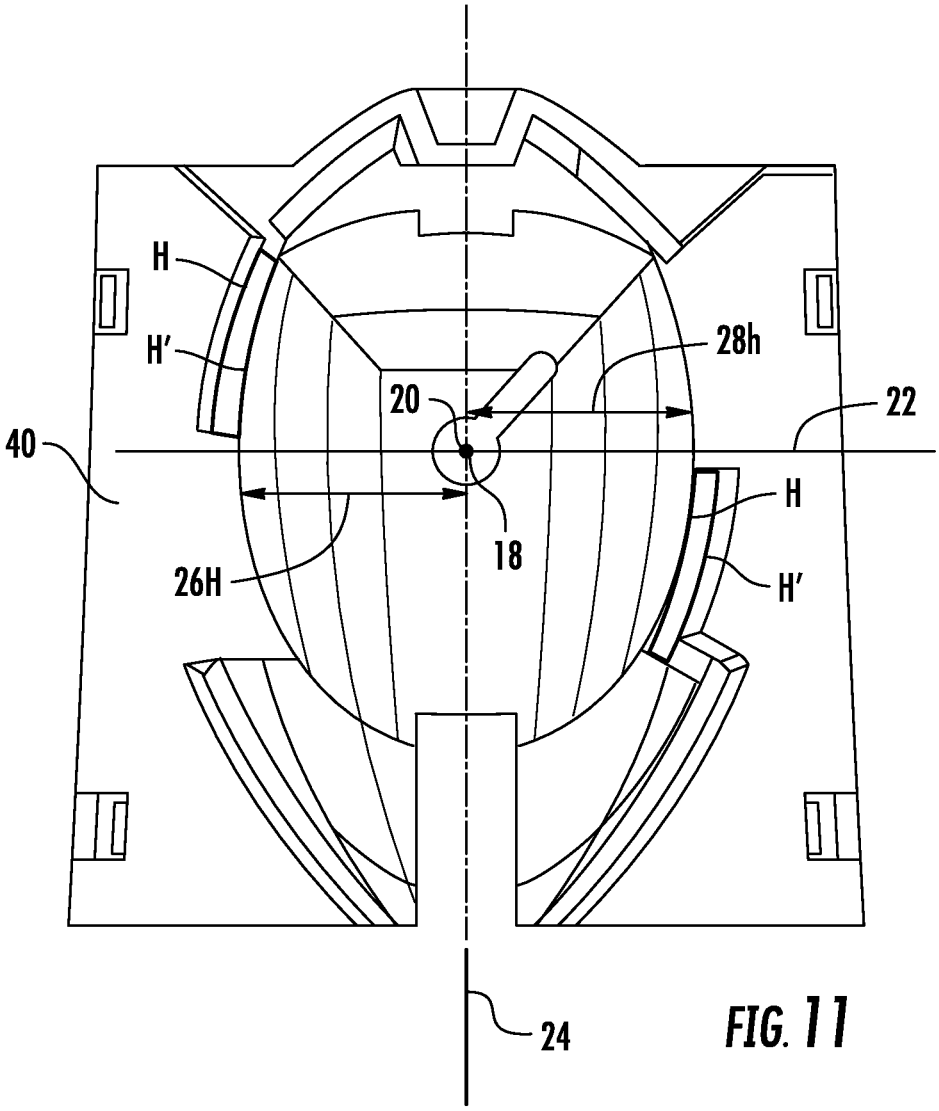
FIG. 11 is a schematic illustration of surface H of an embodiment of a strobe assembly.

As illustrated in FIG. 11, surface set H includes two surfaces H, one disposed at each side of the vertical plane 24. Each surface H is defined by a parabola H' in a plane parallel to the base surface 40, parabola H' having a focal length 26*h*, in an exemplary embodiment, of about 0.760 inches. The parabola H' is extruded or translated along the source axis 20 from the base surface 40 to form the surface H. The surfaces H are truncated by the horizontal surface 22.

Figure 3:
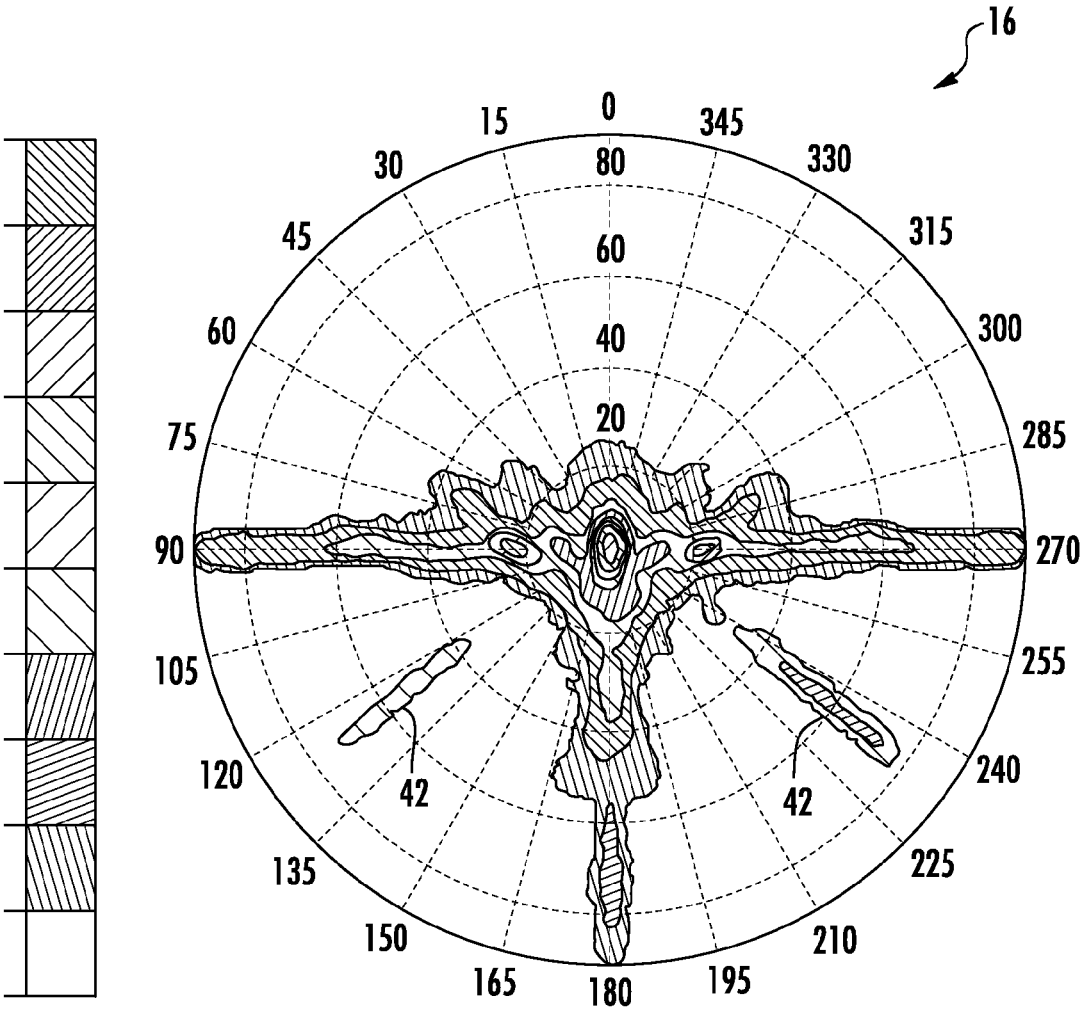
FIG. 3 is a plot of an output pattern of an embodiment of a strobe assembly.
Figure 12:
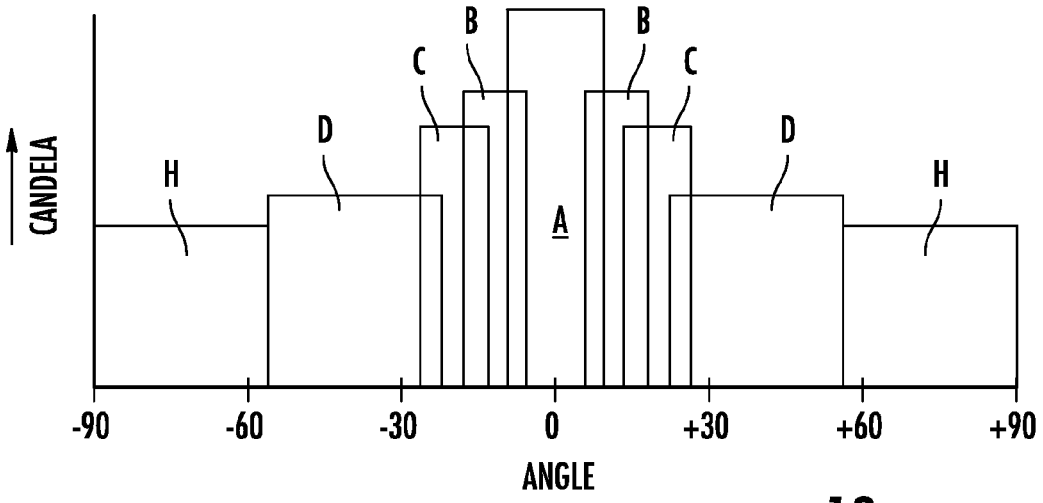
FIG. 12 is a schematic illustration of the output of the strobe assembly in the horizontal plane.
Figure 13:
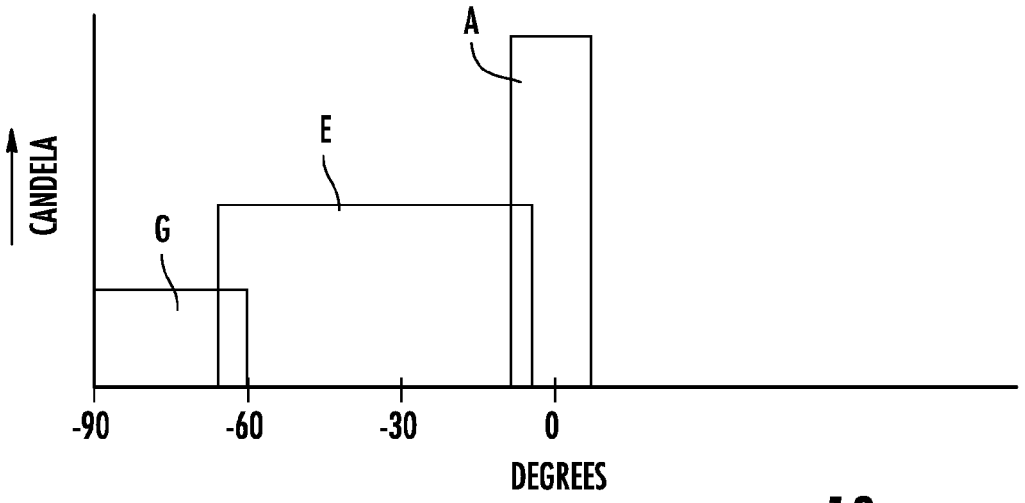
FIG. 13 is a schematic illustration of the output of the strobe assembly in the vertical plane.

This arrangement of surfaces A-H produces the T-shaped output pattern 16 shown in FIG. 3, with the contributions from the surfaces A-H shown in FIGS. 12 and 13. In the horizontal plane, light reflected from surface A is the main contributor between about −10 degrees and about +10 degrees, while the contributions of surface set B are focused on the ranges between about −5 degrees and about −15 degrees, and about +5 degrees and about +15 degrees. The light reflected from surface set C contributes most to the pattern in the ranges of about −15 degrees to about −25 degrees and about +15 to about +25 degrees, while surface set D contributes most in the ranges of about −25 degrees to about −55 degrees and about +25 degrees to about +55 degrees. Finally, surface set H is the main contributor to the pattern in the ranges of about −55 degrees to about −90 degrees and about +55 degrees to about +90 degrees.

Referring to FIG. 13, in the vertical plane, light reflected from surface A is the main contributor to the pattern between about −10 degrees and about +10 degrees. Surface E contributes most to the pattern in the range of about −10 degrees to about −60 degrees, while surface G contributes most in the range of about −60 degrees to about −90 degrees. Referring again to FIGS. 2 and 3, surfaces F shown in FIG. 2 are the main contributors to the 45 degree spot portions 42 of the output pattern 16 of FIG. 3.

The reflector arrangement disclosed herein improves efficiency of the strobe assembly 10 in forming the required pattern while minimizing light energy projected to areas where it is not required, thus reducing the amount of energy required to operate the strobe assembly 10.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A modular reflector assembly comprising:

two portions arranged symmetrically at a common plane, each portion including:

a first surface intersecting the common plane defined by a first parabolic curve revolved about a first axis of revolution rotated to a first angle relative to the common plane;

a second surface abutting the first surface defined by a second parabolic curve revolved about a second axis of revolution rotated to a second angle relative to the common plane, the second angle having a value greater than the first angle;

a third surface abutting the second surface defined by a third parabolic curve revolved about a third axis of revolution rotated to a third angle relative to the common plane, the third angle having a value greater than the second angle;

a fourth surface abutting the third surface defined by a fourth parabolic curve revolved about a fourth axis of revolution rotated to a fourth angle relative to the common plane, the fourth angle having a value greater than the third angle;

a fifth surface abutting the first surface and defined by a fifth parabolic curve revolved about a fifth axis of revolution rotated in the common plane to a fifth angle relative to the first axis of revolution; and a sixth surface abutting the fifth surface and defined by a sixth parabolic curve revolved about a sixth axis of revolution rotated in the common plane to a sixth angle relative to the first axis of revolution, the sixth angle having a greater value than the fifth angle; and two seventh surfaces abutting the sixth surfaces, the seventh surfaces disposed on opposing sides of the common plane, each seventh surface defined to be a seventh parabolic curve translated along the axis of rotation.

2. The reflector assembly of claim 1, wherein the first angle is zero degrees.

3. The reflector assembly of claim 1, wherein all of the first surface, the second surface, the third surface, the fourth surface, the fifth surface and the sixth surface have a common focal point.

4. The reflector assembly of claim 3, wherein the first surface, the second surface, the third surface, the fourth surface, the fifth surface and the sixth surface have unequal focal lengths.

5. The reflector assembly of claim 1, wherein an output pattern of the reflector assembly is T-shaped.

6. A strobe assembly comprising:

a light source disposed along a source axis; and a modular reflector assembly including:

two portions arranged symmetrically at a common plane including the source axis, each portion including:

a first surface intersecting the common plane defined by a first parabolic curve revolved about a first axis of revolution rotated to a first angle relative to the common plane;

a second surface abutting the first surface defined by a second parabolic curve revolved about a second axis of revolution rotated to a second angle relative to the common plane, the second angle having a value greater than the first angle;

a third surface abutting the second surface defined by a third parabolic curve revolved about a third axis of revolution rotated to a third angle relative to the common plane, the third angle having a value greater than the second angle;

a fourth surface abutting the third surface defined by a fourth parabolic curve revolved about a fourth axis of revolution rotated to a fourth angle relative to the common plane, the fourth angle having a value greater than the third angle;

a fifth surface abutting the first surface and defined by a fifth parabolic curve revolved about a fifth axis of revolution rotated in the common plane to a fifth angle relative to the first axis of revolution; and a sixth surface abutting the fifth surface and defined by a sixth parabolic curve revolved about a sixth axis of revolution rotated in the common plane to a sixth angle relative to the first axis of revolution, the sixth angle having a greater value than the fifth angle; and two seventh surfaces abutting the sixth surfaces, the seventh surfaces disposed on opposing sides of the common plane, each seventh surface defined to be a seventh parabolic curve translated along the axis of rotation.

7. The strobe assembly of claim 6, wherein the first axis of revolution is coincident with the source axis.

8. The strobe assembly of claim 6, wherein all of the first surface, the second surface, the third surface, the fourth surface, the fifth surface and the sixth surface have a common focal point.

9. The strobe assembly of claim 8, wherein the first surface, the second surface, the third surface, the fourth surface, the fifth surface and the sixth surface have unequal focal lengths.

10. The strobe assembly of claim 6, wherein an output pattern of the strobe assembly is T-shaped.

* * * * *